US006434955B1

(12) United States Patent
Ng et al.

(10) Patent No.: US 6,434,955 B1
(45) Date of Patent: Aug. 20, 2002

(54) ELECTRO-ADSORPTION CHILLER: A MINIATURIZED COOLING CYCLE WITH APPLICATIONS FROM MICROELECTRONICS TO CONVENTIONAL AIR-CONDITIONING

(75) Inventors: Kim Choon Ng, Singapore (SG); Jeffrey M. Gordon, Sede Boqer (IL); Hui Tong Chua, Singapore (SG); Anutosh Chakraborty, Dhaka (BD)

(73) Assignee: The National University of Singapore, Singapore (SG)

( * ) Notice: Subject to any disclaimer, the term of this patent is extended or adjusted under 35 U.S.C. 154(b) by 0 days.

(21) Appl. No.: 09/922,712

(22) Filed: Aug. 7, 2001

(51) Int. Cl.[7] ..... F25B 17/00; F25B 21/02

(52) U.S. Cl. ..... 62/106; 62/144; 62/480; 62/3.3

(58) Field of Search ..... 62/101, 106, 109, 62/480, 3.2, 3.3, 141, 142, 144

(56) References Cited

U.S. PATENT DOCUMENTS

| | | | |
|---|---|---|---|
| 3,734,293 | A | 5/1973 | Biskis |
| 5,046,319 | A | 9/1991 | Jones |
| 5,157,938 | A | 10/1992 | Bard et al. |
| 5,463,879 | A | 11/1995 | Jones |

FOREIGN PATENT DOCUMENTS

| | | | |
|---|---|---|---|
| JP | A6154593 | | 3/1986 |
| JP | 06154543 | A * | 6/1994 |
| JP | 10202041 | A * | 8/1998 |
| JP | A2000-39428 | | 2/2000 |

OTHER PUBLICATIONS

Ramaswamy, et al, IEEE Transactions on Components and Packaging Technologies, pp. 1–7 (Mar. 2000).
Drost, et al, Aiche 1998 Spring National Meeting, New Orleans, 5 pgs. (Mar. 1998).
Uemura, Applications of Thermoelectric Cooling, pp. 622–631 (1998).
Viswanatham et al, Adsorption, vol. 4, pp. 299–311 (1998).
Boelman et al, Ashrae Transactions: Research, vol. 103, Part 1, pp. 139–148 (1997).
Cho et al, Energy, vol. 17, No. 9, pp. 829–839 (1992).
Chua et al, International Journal of Refrigeration, vol. 22, pp. 194–204 (1999).

* cited by examiner

*Primary Examiner*—Chen-Wen Jiang
(74) *Attorney, Agent, or Firm*—Birch, Stewart, Kolasch & Birch, LLP

(57) ABSTRACT

A novel modular and miniature chiller is proposed that symbiotically combines absorption and thermoelectric cooling devices. The seemingly low efficiency of each cycle individually is overcome by an amalgamation with the other. This electro-adsorption chiller incorporates solely existing technologies. It can attain large cooling densities at high efficiency, yet is free of moving parts and comprises harmless materials. The governing physical processes are primarily surface rather than bulk effects, or involve electron rather than fluid flow. This insensitivity to scale creates promising applications in areas ranging from cooling personal computers and other micro-electronic appliances, to automotive and room air-conditioning.

19 Claims, 7 Drawing Sheets

ELECTRO-ADSORPTION CHILLER: A MINIATURIZED COOLING CYCLE WITH APPLICATIONS FROM MICROELECTRONICS TO CONVENTIONAL AIR-CONDITIONING

BACKGROUND OF THE INVENTION

1. Field of the Invention

The present invention relates to an electrically driven cooling cycle that makes use of the symbiotic effects of adsorption and thermoelectric cooling cycles to produce a useful cooling effect at an evaporator.

2. Description of Background Art

A central challenge in cooling science today is the development of miniaturized chillers, in particular for microelectronic appliances such as personal computers. The general aim is to develop a device that is: (1) compact; (2) virtually free of moving parts and reliable; (3) efficient in converting input to cooling power (i.e., a high Coefficient Of Performance or COP for short); (4) capable of high cooling densities typically measured in Watt per square centimeter ($W/cm^2$); and (5) affordable. (COP is defined as the ratio of useful cooling power to input power).

Various types of cooling devices have been, hitherto, proposed or commercialised for the above-mentioned purposes. The simplest is forced air convection with the option of an extended heat sink that effectively increases the heat source surface area for heat exchange and/or the possibility of introducing ribs or barriers on the surfaces to be cooled to increase air turbulence so as to realize better heat dissipation. This method is adequate for many types of current microelectronic cooling applications; however, the current methods might cease to satisfy the compactness constraints of future generations of microelectronic cooling applications that will require a cooling density at least an order of magnitude higher than presently required.

Thermoelectric chillers are also in use, but suffer from inherently low COP (typically in the range of 0.1–0.5 for the temperature ranges characteristic of many microelectronic applications) and high cost. The low COP means that major increases in cooling density will require unacceptably high levels of electrical power input and rates of heat rejection to the environment that will be difficult to satisfy in a compact package, all at increased cost.

Passive thermo-syphons have been proposed. These devices involve virtually no moving parts, except with the possibility of one or more cooling fans at the condenser. Such a device; however, is highly orientation dependent, since it relies on gravity to feed condensate from a condenser located at a higher elevation so as to provide liquid flush back to the evaporator, which is located at a lower elevation.

Thermo-syphons equipped with one or more mini pumps have also been proposed [1]. Instead of relying on gravity, condensate is pumped from the condenser back to the evaporator. This scheme is orientation independent and also allows for the possibilities of forced convective boiling, spraying of condensate or jet-impingement of condensate at the evaporator, which will effectively enhance boiling characteristics and therefore cooling performance.

Laid-out heat pipes [2,3] have found applications especially in laptop computers. The evaporating ends of the heat pipes are judiciously arranged over the CPU while the condensing ends of the same are laid out so as to effectively increase the surface area of the heat sink.

Mini vapour compression chillers [4] have also found applications. In one design, the evaporator is arranged over the heat source surface while the mini condensing unit is positioned away from the heat source. The advantage of such a system lies in its higher COP. However, many moving parts are involved in the compressor and they have to be highly reliable. Further scaling down of the compressor for miniaturized cooling applications may also be a technical challenge, and this may lead to a sizable loss of compressor efficiency due to high flow leakages and in turn the low chiller COP.

Thermoelectric chillers [5] satisfy the requirement of compactness, the absence of moving parts except for the possibility of one or more cooling fans, and an insensitivity to scale (since energy transfers derive from electron flows). Typically, commercial thermoelectric devices comprise semiconductors, most commonly Bismuth Telluride. The semiconductor is doped to produce an excess of electrons in one element (n-type), and a dearth of electrons in the other element (p-type). Electrical power input drives electrons through the device. At the cold end, electrons absorb heat as they move from a low energy level in the p-type semiconductor to a higher energy level in the n-type element. At the hot side, electrons pass from a high energy level in the n-type element to a lower energy level in the p-type material, and heat is rejected to a reservoir.

Thermoelectric devices have found niche applications for small-scale cooling. When substantial temperature differences are needed, thermoelectric devices inherently suffer from low COP, with the concomitant drawbacks of relatively high power input, accommodating even greater heat rejection, and an appreciable cost per watt of cooling power.

Adsorption chillers have been proposed to cool electronic devices in space capsules [1]. The advantage of such devices is that they are virtually free of moving parts, except for the on-off valves that separately connect the reactors to the evaporator and condenser (therefore these units are highly reliable). Adsorption chillers are also capable of being miniaturized [6], since adsorption of refrigerant into and desorption of refrigerant from the solid adsorbent are primarily surface, rather than bulk processes [7–13]. A refrigerant such as water is exothermically adsorbed, and endothermically desorbed, from the porous adsorbent, which is usually packed in a reactor having good heat transfer characteristics.

Many adsorbent-adsorbate pairs are available, such as silica gel-water, silica gel-methanol, zeolite-water, activated carbon-nitrogen, activated carbon-methanol, etc. Silica gel-water has been the preferred pair in commercial adsorption chiller development targeted for process cooling or air-conditioning owing to: (a) silica gel's comparatively large uptake capacity for water; (b) the high latent heat of evaporation of water; (c) the relatively low temperatures for desorption; and (d) the harmless nature of the chemicals.

However the COP of commercial adsorption chiller driven by low temperature waste heat (typically less than 85° C.) is low, typically in the range of 0.1–0.6 for typical air-conditioning and process cooling uses. The intrinsically low COP is related to: (i) small temperature differences among the reservoirs; and (ii) the batch-wise system operating characteristics.

The technology of coupling a thermoelectric device (often referred to as a Peltier device), to an adsorber and a desorber is not new [14]. It is typically applied to humidification, dehumidification, gas purification, and gas detection. Its application in an integral chiller system—i.e., to produce a thermodynamic cooling cycle—so as to realize the above-mentioned virtues has, hitherto, not been proposed.

In one version, a thermoelectric device is connected to one reactor [15; 16; 17]. Since one junction of the thermoelectric device is able to act either as the cooling end (with the other junction concomitantly acting as a heating end) or the heating end (with the other junction concomitantly acting as a cooling end) simply by means of switching the direction of direct current, the same junction is attached to the reactor in a thermally conductive but electrically non-conductive manner. If the reactor is designated to be an adsorber or absorber, direct current will be applied through the thermoelectric device in a manner such that the junction acts as the cooling end so that the heat generated by the adsorber or absorber is removed by the thermoelectric device to the environment. Conversely, if the reactor is designated to be a desorber or generator, the direction of flow of direct current through the thermoelectric device is reversed so that the junction acts as the heating end and supplies heat to the desorber to sustain the vapor desorption or generation. Such applications are typically found in applications related to dehumidification, gas purification, gas detection, etc.

In another version that is more relevant to the present invention, the two junctions of a thermoelectric device are separately attached in a thermally conductive but electrically non-conductive manner to two reactors [14; 18]. When direct current is applied to the thermoelectric device, the reactor attached to the cold junction acts as either an adsorber or absorber, while the second reactor attached to the hot junction acts as a desorber. When the direction of flow of direct current through the thermoelectric device is reversed, the original cold junction is switched into a hot junction, which in turn also switches the reactor from an adsorber or absorber to a desorber. Concomitantly, the original hot junction is switched into a cold junction, which in turn also switches the reactor from a desorber to an adsorber or absorber. Such applications are typically found in gas purification.

SUMMARY OF THE INVENTION

We will now explain how a unique union of the adsorption and thermoelectric chillers (electro-adsorption chiller) can produce a device that simultaneously fulfils the following aims: (a) scale independence, and hence the option of chiller miniaturization and system compactness; (b) no moving parts; (c) option of no coolant loops; (d) relatively high COP; (e) sizable cooling densities; (f) production from existing technologies (namely, its realization is not contingent upon the development of new materials or unfamiliar components); (g) modularity, which offers the possibility of assembling macro-cooling rates (of the order of kilowatts) from many miniaturized cooling units; and (h) fabrication from non-toxic environmentally-friendly materials.

In the present invention, an adsorption chiller equipped with one or more pairs of reactors is combined with one or more thermoelectric chillers. The number of thermoelectric chillers used is equal to the number of pairs of reactors equipped in the adsorption chiller. Each thermoelectric chiller is disposed such that its two junctions are separately attached in a thermally conductive but electrically non-conductive manner to two reactors, with the two reactors being in contact in a like manner only with the thermoelectric chiller and not with other thermoelectric chillers. Hence, every pair of reactors and every thermoelectric chiller form one module in the adsorption chiller.

For compactness, the electro-adsorption chiller is arranged in a modular manner, where the pairs of reactors of the chiller are linked to a vacuum-type spool valve, operated by spring-loaded and electrically-activated piezoelectric transducers that are positioned either at one or both ends of the valve piston. The outlets from the valve chambers are connected internally (to remain hermetically sealed) via the valve housing to the condenser and evaporator, respectively.

According to one aspect of the present invention, there is provided an electro-adsorption chiller assembly comprising:

a condenser, wherein the refrigerant can be cooled by forced air convection, radiation, laid out heat pipes, by liquid coolant and/or such other means that are practiced by those skilled in the art;

an evaporator that produces useful cooling, which is connected to said condenser by means of a simple on-off pressure reducing valve operated by means of electromagnetic, pneumatic, hydraulic, solid-state or other principles so as to provide a refrigerant circuit; or an evaporator that produces useful cooling which is connected to said condenser by means of a simple on-off valve operated by means of electromagnetic, pneumatic, hydraulic, solid-state or other principles and a serially connected hermetic or semi-hermetic pump that can either spray the refrigerant onto the evaporator heat exchanger surface or distribute the refrigerant via a jet-impingement technique onto the evaporator heat exchanger surface so as to provide a refrigerant circuit with markedly enhanced evaporator boiling characteristics;

one or more pairs of reactors connected by simple on-off or spool valves operated by means of electromagnetic or piezoelectric, pneumatic, hydraulic, solid-state or other principles to both the condenser and evaporator so as to provide a refrigerant circuit such that each reactor is able to operate in adsorption and desorption modes;

one or more thermoelectric chillers with their number matched to the number of pairs of reactors so that every thermoelectric chiller is dedicated to only one pair of reactors and with each of the thermoelectric chiller's two junctions separately connected in a thermally conductive but electrically non-conductive manner which can be achieved by such means as ceramic plates to the two reactors and connected to a DC power source that is able to perform a voltage polarity switch so that each of the junctions is able to operate as a heating end and a cooling end, and able to optionally supply varying power to every thermoelectric chiller; and control means for controlling the process time interval, the on-off control valves, the voltage polarity of the DC power source, the power supply by the DC power source to each of the thermoelectric chillers such that one of its two junctions operate as a cooling end and the reactor attached to the cooling end is cooled down while it is isolated from both the condenser and evaporator and subsequently connected serially to the evaporator to operate as an adsorber adsorbing vapour refrigerant from the evaporator for a substantial period of time and the other junction simultaneously operating as a heating end and the reactor attached to the heating end is heated up while it is isolated from both the condenser and evaporator and subsequently connected serially to the condenser and operates as a desorber desorbing vapour refrigerant to the condenser for a substantially identical time interval, and the pump, if any, that is installed between the condenser and evaporator.

In a preferred embodiment, the refrigerant is water and the adsorbent is silica gel. However, other polar fluids such as methanol, ammonia, etc. or polar dielectric refrigerant can be used. Similarly, other adsorbents such as zeolite or activated carbon can be used.

The reactor is preferably composed of good heat exchanging material and contains a predetermined amount of adsorbent. The adsorbent could be any material, such as silica gel, that is able to adsorb refrigerant, either by physisorption and/or chemisorption, for example water vapour, ammonia, methanol, etc. at a temperature dictated by the thermoelectric device's cold junction temperature which is preferably below ambient temperature and with its lower limit dictated by the thermodynamic properties of the refrigerant so that the adsorbing capacity of the adsorbent can be markedly increased and desorbs refrigerant at a temperature dictated by the thermoelectric device's hot junction temperature which is typically less than 100° C.

Several known options are available for the evaporator design, depending on the cooling power density (in Watts per unit area) required and on the need for orientation independence.

In one aspect, the evaporator can be designed for a common pool-boiling mode as is typically found in conventional air-conditioning and refrigeration systems. In such a design, it would suffice by simply connecting the condenser and evaporator with an on-off pressure reducing control valve with the additional option of installing a typical flooded U-tube bend so as to maintain the pressure difference between the condenser and evaporator. However, this design can satisfy neither the orientation-independent constraint nor the requirement of cooling densities of 10 $W/cm^2$ or higher.

In a second aspect, the evaporator can again be designed in the common pool-boiling mode with the additional installation of micro channels or even stacked-up micro channels with a honeycomb-like configuration in the pool of refrigerant and are in good thermal contact and possibly good mechanical contact with the surfaces through which thermal power is received by the pool of refrigerant so as to increase the cooling densities by effectively increasing the ratio of heat transfer surface area to volume. However, this design again cannot satisfy the orientation-independent constraint.

In a third aspect, refrigerant is mechanically sprayed onto the heat transfer surfaces of the evaporator via a distributor with the heat transfer surfaces being preferably installed with micro channels which are in good thermal and mechanical contact with the heat transfer surface of the evaporator. In this design, an on-off control valve and a downstream hermetic or semi-hermetic pump have to be installed between the condenser and evaporator so that the condensed refrigerant is pressurized by the pump and delivered to the distributor. This design is able to satisfy the orientation-independent constraint as well as the need for high cooling density.

In a fourth aspect, refrigerant is sent to the heat transfer surface by a high velocity jet-impingement method via a jet array with the heat transfer surfaces being preferably installed with micro channels which are in good thermal and mechanical contact with the heat transfer surface. In this design, an on-off control valve and a downstream hermetic or semi-hermetic pump have to be installed between the condenser and evaporator so that the condensed refrigerant is pressurized by the pump and delivered to the array of jets. This design is able to satisfy the orientation-independent constraint and the need for high cooling density. Owing to the small droplet radii produced by the injector, they could withstand a high degree of liquid superheating and thus, could remain liquid (droplet projectiles) until impingement occurs at the heat transfer surfaces.

In a preferred embodiment, the condenser is composed of a fan-cooled finned tube bundle array where the refrigerant in the tubes is cooled by forced air convection so as to realize a compact system. Alternatively the condenser could be designed with a known shell-and-tube design, where the refrigerant is contained in the shell and the coolant is driven in the tube by means of a pump and cooled by forced air convection. In yet another known design, the condenser could still be designed with a known shell-and-tube design, where the refrigerant is contained in the shell and the tubes are part of a laid-out heat pipe assembly so that heat is dissipated from the condenser through the heat pipe to the environment. An additional condenser design comprises a micro-channel heat transfer surface and/or stacked porous matrix with high thermal conductivity.

In every pair of reactors, when one reactor is being cooled and eventually functions as an adsorber, the other reactor is being concomitantly heated and eventually functions as a desorber for a substantially identical period. When more than one pair of reactors are installed in the electro-adsorption chiller, the operation of each pair of reactor is advantageously staggered so that the temperature profile in the evaporator can be smoother than that experienced when only one pair of reactors is being installed in the chiller.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 4(*a*) illustrates an operational mode, where the reactors 5 & 12 are linked to evaporator 1 and condenser 9, respectively. FIG. 4(*b*) illustrates a reverse operational mode to FIG. 4(*a*). FIG. 4(*c*) illustrates an operational mode where the reactors 5 & 12 are isolated from condenser 9 and evaporator 1;

DESCRIPTION OF THE PREFERRED EMBODIMENTS

Figure 1:
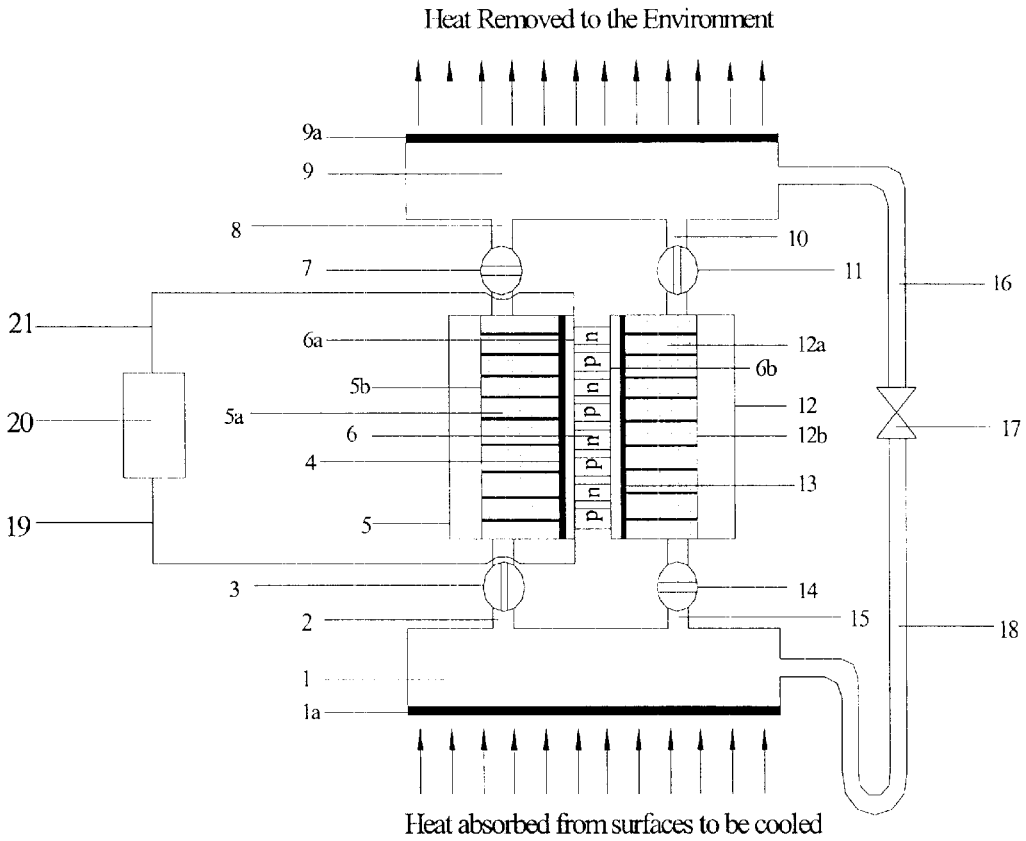
FIG. 1 is a schematic of an electro-adsorption chiller with a flooded-pressure expansion valve according to one embodiment of the present invention.

Referring to the drawings, FIG. 1 illustrates a schematic view of one embodiment of an electro-adsorption chiller equipped with a flooded-pressure expansion valve that constitutes one aspect of the present invention. From the evaporator 1, heat is transferred from the heat spreader or substrate 1*a* where the latter is in direct contact with a surface to be cooled. After adequate heat transfer is effected, boiling of refrigerant (e.g., water vapour) takes place within the evaporator 1 and the generated vapour flows into the reactor 5 via the pipe 2 and an on-off valve 3 (which is activated during the adsorption mode). The presence of a positive pressure gradient across the evaporator 1 and the reactor 5 affects the flow of refrigerant.

Accordingly, the other end of reactor 5 is shut to the condenser 9 by valve 7. Reactor 5 contains a pre-determined amount of absorbent 5*a,* sealed within the finned surfaces 4 on one end and a perforated stainless steel mesh 5*b* on the other. The absorbent adsorbs refrigerant, and heat generated by the exothermic process is rejected via the finned surfaces 4. The temperature of the finned surfaces 4 is maintained at a temperature below that of the ambient environment by the cold junctions of the thermoelectric device 6, which is powered by an electric current (DC) from a power source or battery 20. Electricity flows through the electrical leads 19 and 21 to the thermoelectric device 6. Depending on the operation mode of the reactor 5 in a batch-operated cycle, the direction of the DC current can be reversed should reactor 5 be operated as a desorber.

Accordingly, in another mode of operation (referring to FIG. 1), the condenser 9 is opened to the reactor 12 via the pipe 10 and an on-off valve 11 (which is activated during the desorption mode). Vapour flows from the reactor 12 into the condenser 9 under the effect of a positive pressure gradient. In this mode, the other end of the reactor 12 is shut to the evaporator 1 via valve 14. The reactor 12 contains a predetermined amount of absorbent 12*a,* sealed within the finned surfaces 13 on one end and a perforated stainless steel mesh 12*b* on the other. Refrigerant is desorbed from the absorbent and heat is received via the finned surfaces 13. The high temperature of the finned surfaces 13 is maintained by the hot junctions of the thermoelectric device 6, where the latter is powered by an electric current (DC) from a power source or battery 20. Electricity flows through the electrical leads 19 and 21. Depending on the operation mode of the reactor 12, the direction of current can be reversed should the reactor 12 be operated as an adsorber.

In order to ensure that the thermoelectric device 6 operates properly, each of the two junctions are separately connected in a thermally conductive but electrically non-conducting manner. This can be achieved by providing ceramic plates between the two reactors 5 and 12. The thermoelectric device is connected to the battery 20 in such a manner that this DC power source is capable of performing a voltage polarity switch so that each of the two junctions can operate as a heating end and a cooling end at any given time.

The entire system is operated under the control of a control device, which is connected to each of the various elements. The control device controls the process time interval of the system, the on-off control valves 3, 7, 11 and 14, the voltage polarity of the DC power source, and the power supply by the DC power source to the thermoelectric device 6. Accordingly, each of the two junctions of the thermoelectric device 6 is capable of being operated as a cooling end or a heating end. When operating as a cooling end, the reactor 5 or 12 attached to the cooling end is cooled down while it is isolated from both the condenser 9 and the evaporator 1 and subsequently connected serially to the evaporator 1 to operate as an adsorber, adsorbing vapour refrigerant from the evaporator 1 for a substantial period of time. When operating as a heating end, the reactor 5 or 12 attached to the heating end is cooled down while it is isolated from both the condenser 9 and the evaporator 1 and subsequently connected serially to the evaporator 1 to operate as an desorber, desorbing vapour refrigerant from the evaporator for a substantial period of time The roles of the condenser 9 and evaporator 1 are functionally similar to those found in a conventional chiller, that is, the condenser 9 rejects heat to the ambient environment via air-cooled finned surfaces 9*a* or coiled-tubes, while the evaporator 1 draws heat from the heat source surface. The link between the condenser 9 and evaporator 1 is via small tubes 16 and 18 as well as the expansion valve 17. The configuration shown here is that of a conventional flooded-U-tube arrangement, and thus no control strategy is offered for the operation of valve 17.

Figure 2:
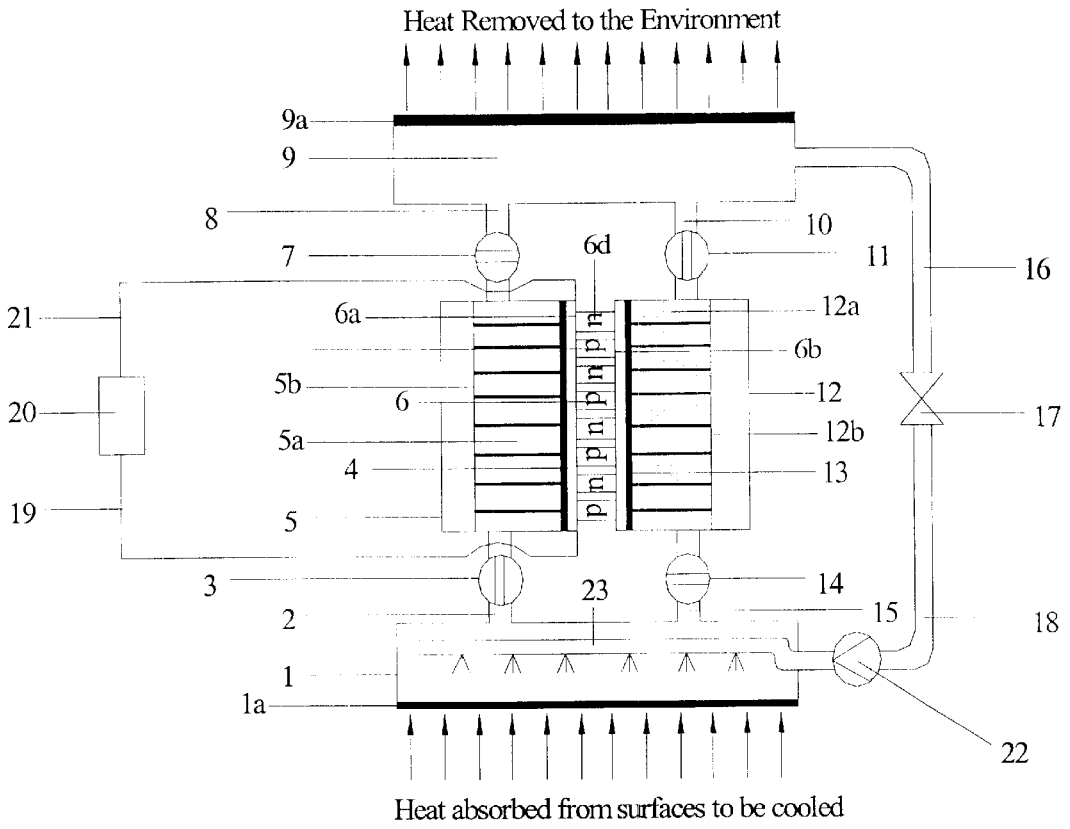
FIG. 2 is a schematic of an electro-adsorption chiller with a mechanically sprayed valve according to one embodiment of the present invention.

Another drawing, FIG. 2, illustrates a schematic view of another embodiment of the chiller, equipped with an electromechanical spray nozzle 23 and housed within the evaporator 1. Together, they constitute another aspect of the claimed invention. An electrically operated pump or injector 22 is used to inject the liquid refrigerant at a suitable pressure into the spray nozzles 23. Within the evaporator 1, heat is transferred from the heat spreader substrate la where the latter is in direct contact with a surface to be cooled. Boiling of refrigerant (e.g., water vapour) takes place within the evaporator 1 and the generated vapour flows into the reactor 5 via the pipe 2 and an on-off valve 3 (which is activated to be opened during the adsorption mode) caused by the presence of a positive pressure gradient. At this time, the other end of reactor 5 is shut to the condenser 9 by valve 7. Reactor 5 contains a pre-determined amount of absorbent 5*a,* sealed within the finned surfaces 4 on one end and a perforated stainless steel mesh 5*b* on the other. Refrigerant (water vapour) is adsorbed by the absorbent, and the heat generated by the exothermic process is rejected by the finned surfaces 4. The temperature of the finned surfaces 4 is maintained low by the cold junctions of thermoelectric device 6, where the latter is powered by an electric current (DC) from a power source or battery 20. The electricity flows through the electrical leads 19 and 21. Depending on the operation mode of the reactor 5, the direction of current can be reversed should the reactor 5 be operated as a desorber.

Accordingly, in another mode of operation (referring to FIG. 2), the condenser 9 is opened to the reactor 12 via the pipe 10 and an on-off valve 11 (which is activated to be opened during the desorption mode). Vapour flows from the reactor 12 into the condenser 9 under the effect of a positive pressure gradient. In this mode, the other end of chamber 12 is shut to the evaporator 1. Reactor 12 contains a predetermined amount of absorbent 12*a,* sealed within the finned surfaces 13 on one end and a perforated stainless steel mesh 12*b* on the other. Refrigerant (water vapour) is desorbed from the absorbent and heat is received via the finned surfaces 13. The temperature of finned surfaces 13 is maintained high by the hot junctions of thermoelectric device 6, where the latter is powered by an electric current (DC) from a power source or battery 20. The electricity flows through the electrical leads 19 and 21. Depending on the operation mode of the reactor 12, the direction of current can be reversed should the reactor 12 be operated as an adsorber.

The roles of the condenser 9 and evaporator 1 are functionally similar to those found in any conventional chiller; that is the condenser 9 rejects heat to the ambient environment via air-cooled finned surfaces or coiled-tubes whilst the evaporator 1 draws heat from the heat source surface. Spray nozzles 23 can be incorporated that deliver streams of micro droplets (liquid droplets up to tens or hundreds of microns acting like projectiles) landing on the heated surfaces of the heat spreader before vaporizing into vapour. The rate of droplet delivery can be varied digitally by a computerized system through a feedback signal according to the cooling demand of the evaporator 1. The link between the condenser 9 and evaporator 1 (other than the reactors) is via small tubes 16 and 18 as well as the expansion valve 17.

Figure 3:
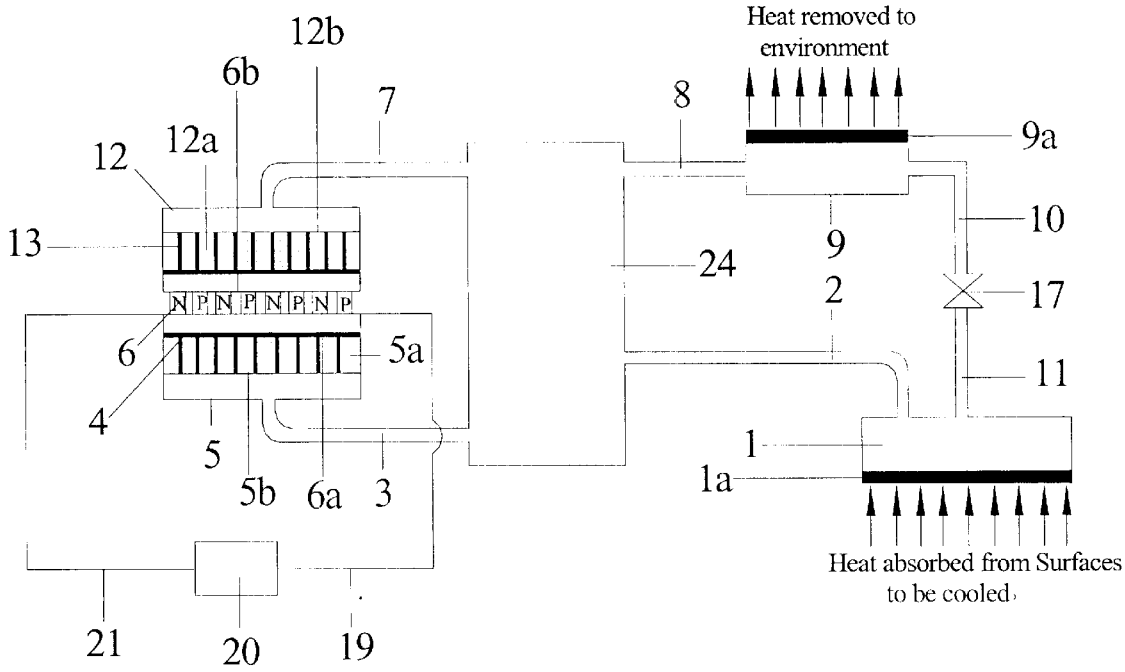
FIG. 3 is a schematic of an electro-adsorption chiller with a spool-valve placed in between the thermoelectrics/reactor beds and the condenser and the evaporator according to one embodiment of the present invention.

A piezoelectric-activated spool valve can be used in all of the above-mentioned embodiments and constitutes another aspect of the present invention. FIG. 3 shows a schematic view of an electro-adsorption chiller with a piezoelectric-activated spool-valve 24, sealed hermetically. The function of the spool valve 24 is to provide (i) ease of control for the switching of the reactors 5 and 12, alternating as adsorber and desorber beds over a prescribed cycle time, and (ii) compactness for the reactors to be linked to the condenser 9 and evaporator 1.

Figure 4:
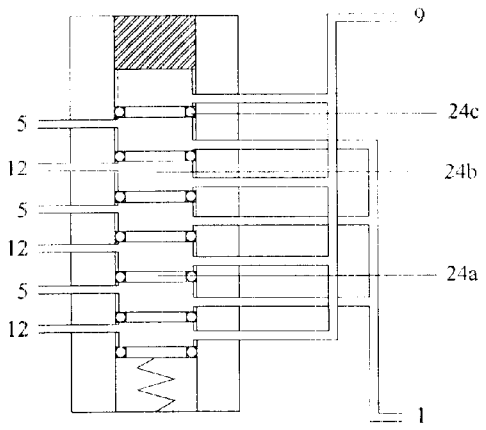
FIG. 4 is a schematic of a spool-valve with suitable "o-rings" and a piston.
Figure 4:
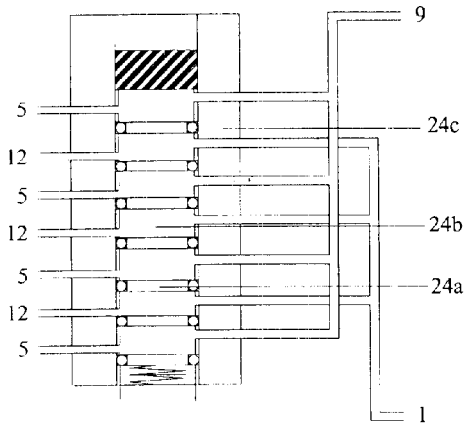
Figure 4:
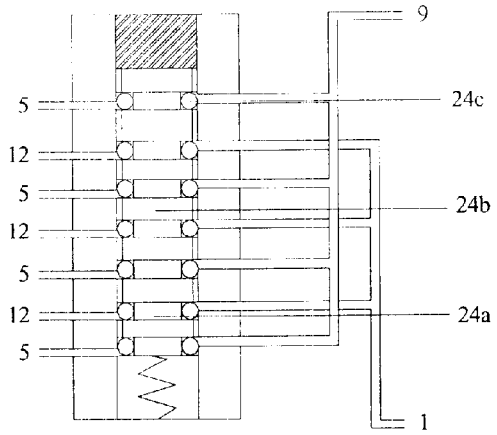

Depending on the number of pairs of reactors (5 and 12) of thermoelectric device 6, the spool-valve can be arranged in a compact manner to provide the passage links to the condenser 9 and the evaporator 1, as shown in FIG. 4(*a*). Also in FIG. 4(*a*), the reactor 5 (when operated as an adsorber) and the reactor 12 (when operated as a desorber) are linked to the evaporator 1 and condenser 9, respectively. In another mode of operation of the spool-valve (shown here in FIG. 4(*b*)), the roles of the reactors 5 and 12 in each pair of electro-adsorption chillers can be switched to adsorber and desorber modes, respectively. This is achieved by the change in the direction of current flow of the power source to the piezoelectric actuator. Accordingly, the spool piston of the compact spool-valve can be positioned such that the reactors (functioning as a desorber) are switched to the condenser 9 and the evaporator 1.

In FIG. 4(*c*), the position of the piston of the spool valve 24 can be manoeuvred to a null position where the reactors (5 and 12) of each pair of electro-adsorption chillers are isolated from the condenser 9 and evaporator 1. This switching mode is a requirement of the batch operation of the electro-adsorption cycle.

Figure 5:
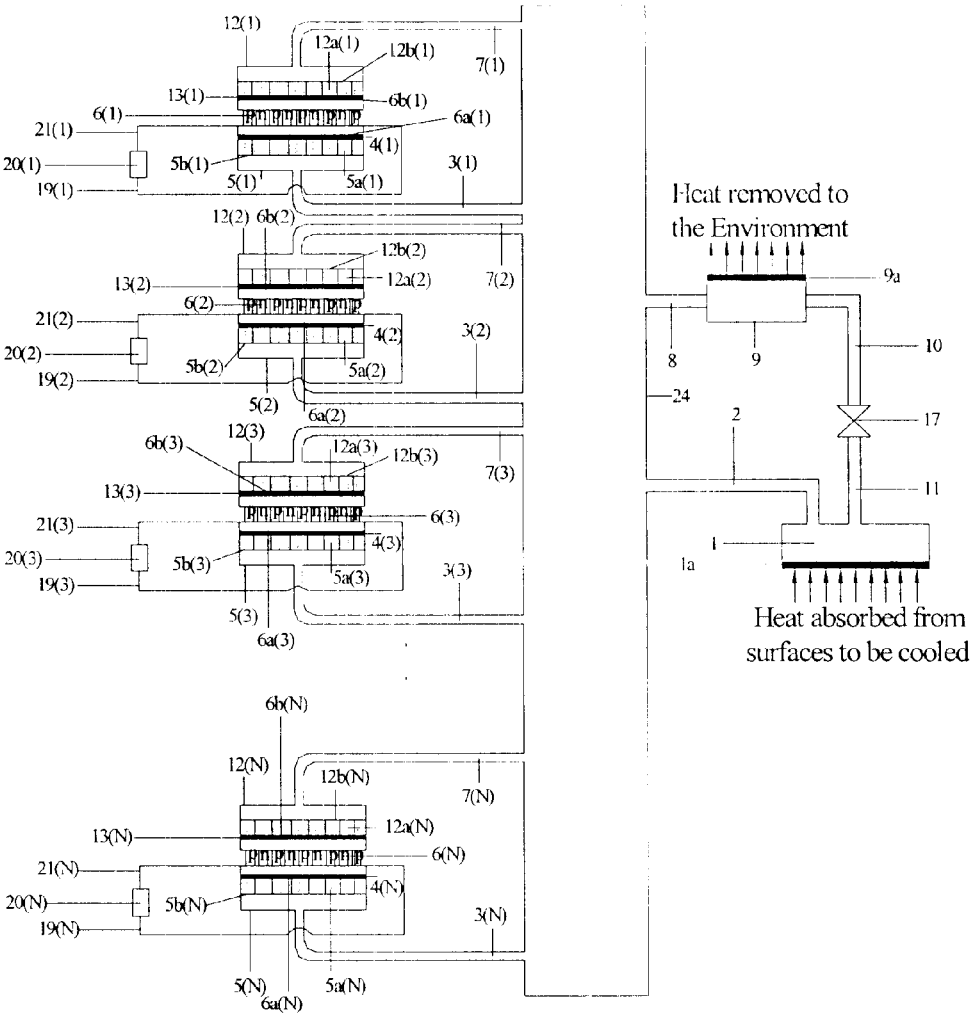
FIG. 5 is a schematic of a multi-pair electro-adsorption chiller with a compact spool-valve arrangement.

Internally, the spool valve 24 is sealed hermetically with grooves 24*a* on the piston 24*b*. Sealing of refrigerant (under partial vacuum) flowing between chambers is affected by "o"-rings 24*c*. Specially designed compartments connect the reactors with fine flow passages within the valve body, linking them to the condenser 9 and evaporator 1 at suitable parts of the batch cycle. Movement of the piston 24*b* during the above-mentioned modes of operation is kept minimal to avoid excessive induced wear on the "o"-rings 24*c*. FIG. 5 shows a compact design of the device with multiple pairs of reactors and the spool-valve 24. The reactors and spool valve 24 represent part of the present invention. The proposed parallel layout of electro-adsorption chillers provides a boost to the total cooling capacity seen by the evaporator 1, and yet the claimed invention remains compactly designed.

Another object of incorporating a spool-valve 24 in the claimed invention is that it permits the remote installation of the "outdoor" unit comprising the reactors (5 and 12), thermoelectric device 6, condenser 9 and the spool valve 24 from the "indoor" unit which consists of the expansion valve 17 and the evaporator 1. The "outdoor" and the "indoor" units are connected by suitable tubes or pipes 2 and 10 that transport the refrigerant, as shown in FIG. 5. This design feature has many advantages in the cooling of compact microchips and printed circuit boards (PCBs), in terms of simplicity, compactness and zero vibration on the CPU or PCBs.

In the electro-adsorption chiller just described, the bed switching is performed simply by reversing the polarity of battery 20 to the thermoelectric device 6. What was formerly the cold junction becomes the hot junction, and vice versa, as shown in FIG. 6(*a*).

Figure 6:
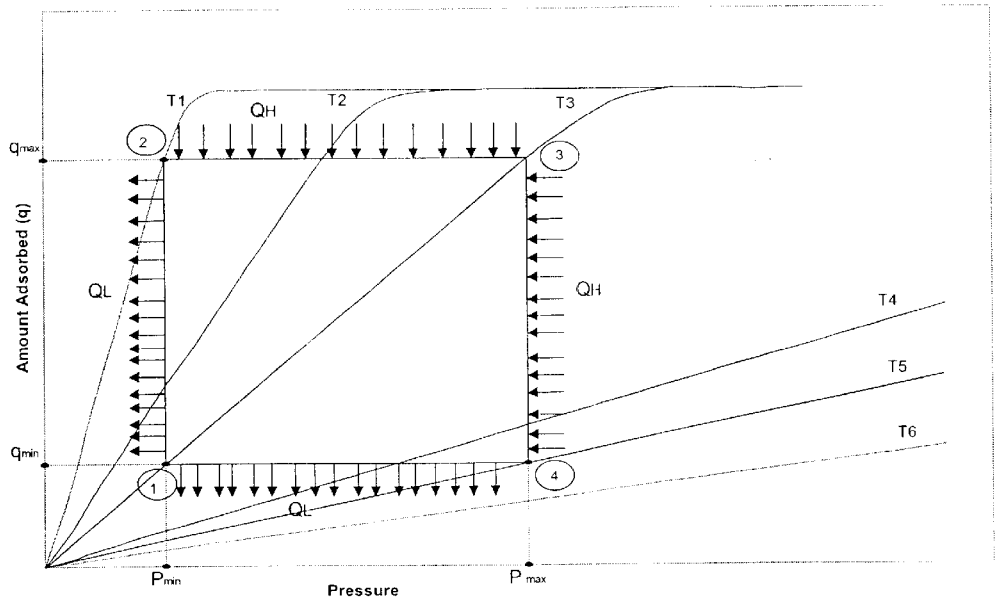
FIG. 6 is a schematic diagram illustrating the principle of operation of a 2-reactor electro-adsorption chiller.
Figure 6:
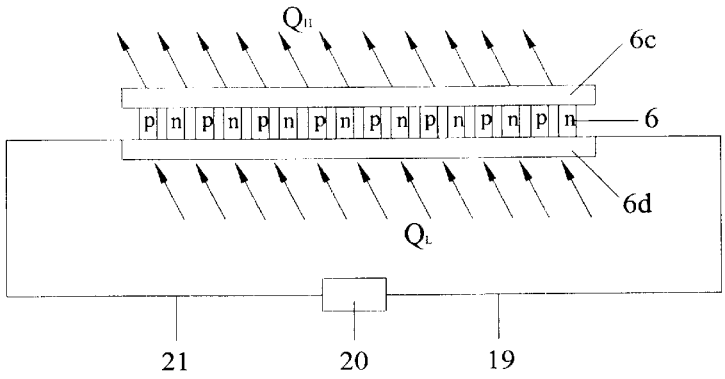

The ideal adsorption cycle ABCD is depicted on a plot of the amount of absorbate adsorbed (q) versus the vapour pressure (P), as shown in FIG. 6(*b*). The desorption process commences from B to D with BC as a switching interval and CD is the cycle interval. Similarly, adsorption starts from D to B with DA and AB as the switching and adsorption intervals. The isotherms associated with the ideal cycle are $T_1$ and $T_5$, which correspond to the adsorber and desorber bed temperatures, respectively. The cycle is now completed. The heating and cooling of the two beds 5 and 12 repeat, along with the flow of refrigerant to and from the condenser 9, evaporator 1, adsorber and desorber.

The evaporator 1 design is distinctly important for the envisioned applications for the following reasons. First, high cooling densities are demanded. Second, the device must be orientation independent and the incorporation of the pump 22 and spray nozzles 23 would enable the evaporator 1 to function in a variety of orientations. The nozzles 23 would inject micro liquid droplets onto a heated substrate 1*a*.

The COP of the electro-adsorption chiller can be expressed in terms of the COPs of the individual adsorption (subscript "ads") and thermoelectric (subscript "TE") chiller by considering the overall energy flows (with all energy flows defined as positive). Referring to FIGS. 1 or 2 and 6, the COPs of the individual components are defined as the nominal cooling rate produced relative to the particular (electric or thermal) power input:

$$COP_{TE}=Q_L/P_{in} \quad (1)$$

$$COP_{ADS}=Q_{evap}/Q_H \quad (2)$$

From the First Law of Thermodynamics, $$P_{in}=Q_H-Q_L \quad (3)$$

The overall or net COP is $$COP_{net}=Q_{evap}/P_{in} \quad (4)$$

which, from equations (1) and (3) can be expressed as:

$$COP_{net}=COP_{ads}(1+COP_{TE}). \quad (5)$$

Equation 5 demonstrates the amplification of the net COP when both systems are symbiotically combined to operate in tandem.

The above equations 1 to 5 relate to a single cooling module. Far larger cooling loads can be accommodated with an assembly of many individual modules, as shown in FIG. 5. A single condenser 9 and evaporator 1 would then be interfaced to the modules, locally or remotely, via a customary spool valve 24.

Figure 7:
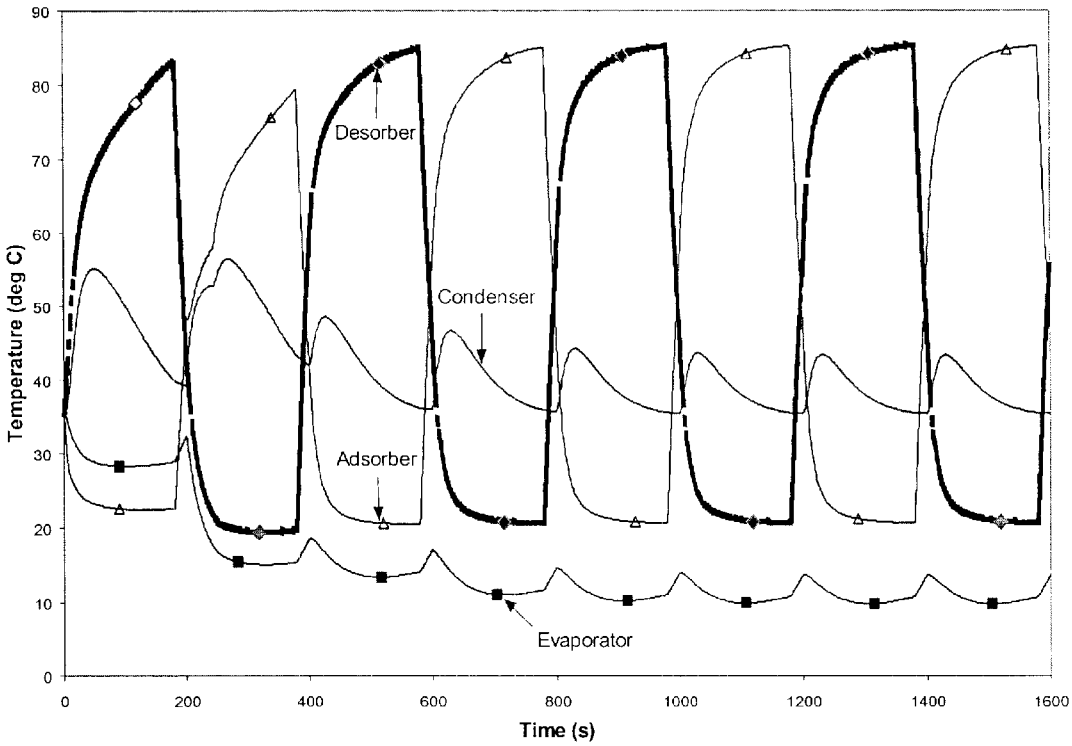
FIG. 7 is a typical temperature profile for the various modules in a 2-reactor electro-adsorption chiller.

Detailed operating schedules for the 2-bed, 4-bed and multi-bed electro-adsorption chillers are presented in Tables 1 to 3. The plurality of the absorbent beds operating with either one or more pairs of condenser-evaporator forms a part of the present invention. The horizontal width of each box shown in the schedules represents the time interval required with respect to the total cycle time. As an example, the performance of a two-bed electro-adsorption chiller has been simulated using the specifications listed in Table 4. For these mentioned parameters, FIG. 7 shows a sample of the numerical solutions to these coupled differential equations. It depicts the predictions of the dynamic temperatures of adsorber 5, desorber 12, condenser 9 and evaporator 1 for 4 full cycles of the electro-adsorption chiller operation. As can be seen from these results, cyclic steady state conditions in the chiller can be achieved in three full cycles. At the specified cooling rate, the net COP of the single electro-adsorption chiller in this particular situation is about 1.2, which is higher than the individual COPs of the thermoelectric or adsorption chiller.

TABLE 1

Energy Utilization Schedule for a 2-reactor electro-adsorption Chiller

| | | | | | | | | |
|---|---|---|---|---|---|---|---|---|
| Reactor-1 | sw | ads | sw | des | sw | ads | sw | des |
| Jun-1 | Cold End | | Hot End | | Cold End | | Hot End | |
| Reactor-2 | sw | des | sw | ads | sw | des | sw | ads |
| Jun-2 | Hot End | | Cold End | | Hot End | | Cold End | |
| | vps | | vps | | vps | | vps | |

Legend:
ads: Reactor operating in adsorption mode (adsorber)
des: Reactor operating in desorption mode (desorber)
sw: switching from adsorber to desorber, i.e. adsorber reactor receives heat from the hot junction of the thermoelectric module or switching from desorber to adsorber, i.e. desorber reactor becomes cool by the cold junction of the thermoelectric module. The reactor operating under this mode is isolated from both the condenser and evaporator.
Jun-1: hot or cold junction of the first junction of a thermoelectric module.
Jun-2: hot or cold junction of the second junction of a thermoelectric module.
vps: voltage polarity switch.
Note:
The width of each box is an indication of the relative time duration over one cycle.

TABLE 2

Energy Utilization Schedule for a 4-reactor electro-adsorption Chiller

| | | | | | | | | |
|---|---|---|---|---|---|---|---|---|
| Reactor-1 | sw | ads | ads | | sw | des | des | |
| | Vps-1 | | | | Vps-1 | | | |
| Jun-1 of TE-1 | Cold End | | Cold End | | Hot End | | Hot End | |
| Reactor-2 | sw | des | des | | sw | ads | ads | |
| | Vps-1 | | | | Vps-1 | | | |
| Jun-2 of TE-2 | Hot End | | Hot End | | Cold End | | Cold End | |
| Rector-3 | des | | sw | ads | ads | | sw | des |
| | | | Vps-2 | | | | Vps-2 | |
| Jun-1 of TE-2 | Hot End | | Cold End | | Cold End | | Hot End | |
| Rector-4 | ads | | sw | des | des | | sw | ads |
| | | | Vps-2 | | | | Vps-2 | |
| Jun-2 of TE-2 | Cold End | | Hot End | | Hot End | | Cold End | |

Legend:
ads: Reactor operating in adsorption mode (adsorber)
des: Reactor operating in desorption mode (desorber)
sw: switching from adsorber to desorber, i.e. adsorber reactor receives heat from the hot junction of the thermoelectric module or switching from desorber to adsorber, i.e. desorber reactor becomes cool by the cold junction of the thermoelectric module. The reactor operating under this mode is isolated from both the condenser and evaporator.
Jun-1: hot or cold junction of the first junction of a thermoelectric module.
Jun-2: hot or cold junction of the second junction of a thermoelectric module.
TE-i: i-th thermoelectric module, where i ranges from 1 to 2.
Vps-j: voltage polarity switch for the j-th thermoelectric module, where j ranges from 1 to 2.
Note:
The width of each box is an indication of the relative time duration over one cycle.

TABLE 3

Energy Utilization Schedule for a multi-reactor electro-adsorption Chiller

| | | | | | | |
|---|---|---|---|---|---|---|
| Reactor-1 | sw | ads | ads | ..... | sw | des |
| | Vps-1 | | | | Vps-1 | |
| Jun-1 of TE-1 | Cold End | | Cold End | ..... | Hot End | |
| Reactor-2 | sw | des | des | ..... | sw | ads |
| | Vps-1 | | | | Vps-1 | |
| Jun-2 of TE-1 | Hot End | | Hot End | ..... | Cold End | |
| Rector-3 | des | | sw | ads | ads | ..... |
| | | | Vps-2 | | | |
| Jun-1 of TE-2 | Hot End | | Cold End | | Cold End | ..... |
| Rector-4 | ads | | sw | des | des | ..... |
| | | | Vps-2 | | | |
| Jun-2 of TE-2 | Cold End | | Hot End | | Hot End | ..... |
| . | . | | . | | . | . |
| . | . | | . | | . | . |
| . | . | | . | | . | . |
| Reactor-(2N-1) | des | | ..... | sw | ads | ..... |
| | | | | Vps-N | | |
| Jun-1 of TE-N | Hot End | | ..... | Cold End | | ..... |
| Reactor-2N | ads | | ..... | sw | des | |
| | | | | Vps-N | | |
| Jun-2 of TE-N | Cold End | | ..... | Hot End | | ..... |

Legend:
ads: Reactor operating in adsorption mode (adsorber)
des: Reactor operating in desorption mode (desorber)
sw: switching from adsorber to desorber, i.e. adsorber reactor receives heat from the hot junction of the thermoelectric module or switching from desorber to adsorber, i.e. desorber reactor becomes cool by the cold junction of the thermoelectric module. The reactor operating under this mode is isolated from both the condenser and evaporator.
Jun-1: hot or cold junction of the first junction of a thermoelectric module.
Jun-2: hot or cold junction of the second junction of a thermoelectric module.
TE-i: i-th thermoelectric module, where i ranges from 1 to N where 2N is the total even number of reactors.
Vps-j: voltage polarity switch for the j-th thermoelectric module, where j ranges from 1 to N.
Note:
The width of each box is an indication of the relative time duration over one cycle.

TABLE 4

Specifications of component and material properties used in the simulation code

| Parameter or material property | Value or descriptive equation, with units |
|---|---|
| **Thermoelectric** | |
| Electrical resistivity | $\rho_{te} = (51120.0 + 163.4T_{av} + 0.6279T_{av}^2) \cdot 10^{-8}$ (ohm-cm) |
| Thermal conductivity | $\lambda_{te} = (62605.0 - 277.7T_{av} + 0.4131T_{av}^2) \cdot 10^{-6}$ (W/cmK) |
| Seebeck coefficient | $\alpha_{te} = (22224.0 + 930.6T_{av} - 0.9905T_{av}^2) \cdot 10^{-9}$ (V/K) |
| Thermoelectric density | $w_{te} = 7.2 \times 10^3$ (kg/m$^3$) |
| No. of thermoelectric couple | $N_{coup} = 30$ |
| Terminal voltage | v = 0.15 volts per unit thermoelectric element |
| Isotherm and kinetic equations of the adsorbent and adsorbate pair. | |
| $q^* = K_0 \cdot \exp\{\Delta H_{ads}/(RT)\} \cdot P \Big/ \left[1 + \{K_0/q_m \cdot \exp\{\{\Delta H_{ads}/(RT)\} \cdot P\}^{t1}\right]^{1/t1}$ | |

TABLE 4-continued

Specifications of component and material properties used in the simulation code

| Parameter or material property | Value or descriptive equation, with units |
|---|---|
| $\frac{dq(t)}{dt} = \frac{15D_{so}e^{-\frac{E_a}{RT}}}{R_p^2}(q^* - q(t))$ | |
| Adsorber/desorber bed heat transfer area | $A_{bed} = 12 \times 10^{-4}$ m$^2$ |
| Specific heat of silica gel | $C_{psg} = 924$ J/kg.K |
| Kinetic constant | $D_{so} = 2.54 \times 10^{-4}$ m$^2$/s |
| Activation energy | $E_a = 4.2 \times 10^{-4}$ J/mole |
| Silica gel mass | $M_{sg} = 2 \times 10^{-3}$ kg |
| Heat exchanger mass including fins | $M_{HX} = 25 \times 10^{-3}$ kg |
| Total surface area of sorption bed | $A_{surface} = 12 \times 10^{-4}$ m$^2$ |

TABLE 4-continued

| Specifications of component and material properties used in the simulation code | |
|---|---|
| Parameter or material property | Value or descriptive equation, with units |
| Average radius of silica gel | $R_p = 1.7 \times 10^{-4}$ m |
| Toth constant | $t_1 = 17$ for type A silica gel. |
| Monolayer capacity | $q_m = 0.29$ kg kg$^{-1}$ for type A silica gel. |
| Pre exponent constant | $K_0 = (1.3 \pm 0.9) \times 10^{-8}$ kg Kg$^{-1}$.kPa$^{-1}$ |
| Isoteric heat of adsorption | $\Delta H_{ads} = 2.8 \times 10^6$ J/kg |
| | Condenser |
| Condenser heat transfer area | $A_{cond} = 10 \times 10^{-4}$ m$^2$ |
| Specific heat of heat exchanger | $C_{PHX} = 903$ J/kg.K |
| Mass of condenser including fins | $M_{cond} = 20.12 \times 10^{-3}$ kg |
| Overall heat transfer coefficient | $U_{cond} = 900$ W/m$^2$.K |
| | Evaporator |
| Evaporator heat transfer area | $A_{evap} = 2.0 \times 10^{-4}$ m$^2$ |
| Specific heat of heat exchanger | $C_{Pevapm} = 383.1$ J/kg.K |
| Mass of evaporator including fins | $M_{evap} = 5.1 \times 10^{-3}$ kg |
| Evaporator heat conductance | $U_{evap} = 4000$ W/m$^2$K |

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The following references have been referred to by footnote numbers throughout the specification and are hereby incorporated by reference thereto:

[1] Drost M. Kevin., Michele Friedrich, Miniature heat pumps for portable and distributed space conditioning applications, AIChE Spring national meeting, New Orleans, March 1998.

[2] Lee, D. Y. and K. Vafai. Comparative analysis of jet impingement and micro channel cooling for high heat flux application, Int. J. Heat Mass Transfer, Vol. 42, pp. 1555–1568, (1999).

[3] Yeh, L. T. Review of heat transfer technologies in electronic equipment, J. Electronic Packaging, Vol. 117, pp. 333–339, (1995).

[4] Schmidt, Roger. Electronics cooling, IBM Corporation, Mailstation P932, (2000).

[5] CRC Handbook of Thermoelectrics (1995). ed by. D. M. Rowe. CRC Press LLC, Boca Raton, Fla.

[6] Viswanathan, Vish V., Robert Wegeng. and Kevin Drost. Microscale Adsorption for Energy and Chemical Systems, Pacific Northwest National Laboratory.

[7] Boelman, E. C. B. B. Saha. and T. Kashiwagi. Parametric study of a silica gel-water adsorption refrigeration cycle—the influence of thermal capacitance and heat exchanger UA-values on cooling capacity, power density, and COP, ASHRAE Trans. Vol. 103. Part 1. pp. 139–148, (1997).

[8] Cho, S. H. and J. N. Kim. Modelling of a silica gel/water adsorption-cooling system, Energy, vol. 17, no. 9, pp. 829–839, (1992).

[9] Chua, H. T., K. C. Ng, A. Malek, T. Kashiwagi, A. Akisawa, and B. B. Saha. Modeling the performance of two-bed, silica gel-water adsorption chillers, Int. J. Refrig., Vol. 22, pp. 194–204, (1998).

[10] Chua, H. T., K. C. Ng, A. Malek, T. Kashiwagi, A. Akisawa, and B. B. Saha, Multi-reactor regenerative adsorption chiller, submitted to INTRO—National University of Singapore patent handling office, patent pending in Singapore, (1998*b*).

[11] Jones, J. A. Regenerative adsorbent heat pump, U.S. Pat. No. 5,046,319, (Oct. 16,1990).

[12] Jones, J. A. Heat cascading regenerative sorption heat pump, U.S. Pat. No. 5,463,879, (Jan. 4, 1994).

[13] Jones, J. A. Three stage sorption type Cryogenic refrigeration systems and employing heat generation, U.S. Pat. No. 5,157,398, (Oct. 22, 1991).

[14] Edward G. Thermoelectric adsorber, U.S. Pat. No. 03,734,293, (Mar. 4, 1970).

[15] Joji, K. Oxygen enriched air generator, JP patent no. 11319463, (May 14, 1998).

[16] Nario, H. and Hayashi Hidechika. Column thermostatic chamber, Japan patent no. 039428, (Jul. 21, 1998).

[17] Kazuyuki, Iguchi, Mitani Toshikazu, and Takeuchi Kazuyos. Dehumidifier of Steam permeable membrane type, JP patent no. 06154543, (Nov. 18, 1992).

[18] Takiya, K. and Negishi Nariaki. Absorbing apparatus, JP patent no. 07185248, (Dec. 28, 1993).

What is claimed is:

1. An electro-adsorption chiller assembly comprising:

at least one condenser for cooling refrigerant;

at least one evaporator for cooling a location to be cooled, said at least one evaporator being connected to said at least one condenser by a pressure isolation device to provide a refrigerant circuit;

at least one pair of reactors connected to said at least one condenser and said at least one evaporator through at least one valve so as to provide a refrigerant circuit such that each reactor is capable of operating in adsorption and desorption modes;

at least one thermoelectric chiller, one of said at least one thermoelectric chiller being provided for each of said at least one pair of reactors, each of said at least one thermoelectric chiller having two junctions separately connected in a thermally conductive but electrically non-conductive manner, each of said at least one thermoelectric chiller being connected to a DC power source that is able to perform a voltage polarity switch so that each of said two junctions is capable of operating as a heating end and a cooling end, said DC power source being capable of supply varying power to each of said at least one thermoelectric chiller; and a control device for controlling a process time interval, said pressure isolation device, the at least one valve between the at least one pair of reactors and said at least one condenser and said at least one evaporator, the voltage polarity of the DC power source, and the power supply by the DC power source to each of said at least one thermoelectric chiller, wherein one of said two junctions operates as a cooling end, one of said at least one pair of reactors attached to said cooling end being cooled down while it is isolated from said at least one condenser and said at least one evaporator and subsequently connected serially to said at least one evaporator to operate as an adsorber adsorbing vapour refrigerant from said at least one evaporator for a substantial period of time, and wherein a second of said two junctions simultaneously operates as a heating end, the other of said at least one pair of reactors attached to the heating end being heated up while it is isolated from said at least one condenser and said at least one evaporator and subsequently connected serially to said at least one condenser to operate as a desorber desorbing vapour refrigerant to said at least one condenser for a substantially identical time interval.

2. The electro-adsorption chiller assembly according to claim 1, wherein said pressure isolation device is an on-off-pressure reducing valve operated by one of the group consisting of electromagnetic, pneumatic, hydraulic, and solid-state power.

3. The electro-adsorption chiller assembly according to claim 1, wherein said pressure isolation device is a flooded U-bend.

4. The electro-adsorption chiller assembly according to claim 1, wherein said pressure isolation device is operated by one of the group consisting of electromagnetic, pneumatic, hydraulic, and solid-state power, said chiller assembly further comprising at least one serially connected hermetic or semi-hermetic pump for spraying refrigerant onto a heat exchanger surface of said at least one evaporator.

5. The electro-adsorption chiller assembly according to claim 1, wherein said pressure isolation device is operated by one of the group consisting of electromagnetic, pneumatic, hydraulic, and solid-state power, said chiller assembly further comprising at least one serially connected hermetic or semi-hermetic pump for distributing the refrigerant onto a heat exchanger surface of said at least one evaporator with a jet-impingement technique.

6. The electro-adsorption chiller assembly according to claim 1, wherein said pressure isolation device is a flooded U-bend, said chiller assembly further comprising at least one serially connected pump for spraying refrigerant onto a heat exchanger surface of said at least one evaporator.

7. The electro-adsorption chiller assembly according to claim 1, wherein said pressure isolation device is a flooded U-bend, said chiller assembly further comprising at least one serially connected pump for distributing the refrigerant onto a heat exchanger surface of said at least one evaporator with a jet impingement technique.

8. The electro-adsorption chiller assembly according to claim 1, wherein said at least one valve is a spool valve operated by one of the group consisting of electromagnetic or pieozoelectric, pneumatic, hydraulic, and solid-state power.

9. The electro-adsorption chiller assembly according to claim 1, wherein each of said reactors in each of said at least one pair of reactors comprises an adsorbent material sealed within a finned surface on one side and a mesh material on the other, said finned surface being located on a side of each of said reactors adjacent said at least one thermoelectric chiller, said mesh material being located on a side of each of said reactors remote from said at least one thermoelectric chiller.

10. The electro-adsorption chiller assembly according to claim 1, wherein there are a plurality of pairs of said reactors connected in parallel with each other to said at least one evaporator and said at least one condenser by a spool valve.

11. The electro-adsorption chiller assembly according to claim 1, wherein there are a plurality of pairs of said reactors connected in parallel with each other, each pair of said reactors is connected to the said at least one evaporator by at least one valve and separately connected to said at least one condenser by another at least one valve.

12. A method of cooling with an electro-adsorption chiller assembly, said method comprising the steps of:

providing at least one condenser for cooling refrigerant;

providing at least one evaporator for cooling a location to be cooled, said at least one evaporator being connected to said at least one condenser by a pressure isolation device to provide a refrigerant circuit;

providing at least one pair of reactors connected to said at least one condenser and said at least one evaporator through at least one valve so as to provide a refrigerant circuit such that each reactor is capable of operating in adsorption and desorption modes;

providing at least one thermoelectric chiller, one of said at least one thermoelectric chiller being provided for each of said at least one pair of reactors, each of said at least one thermoelectric chiller having two junctions separately connected in a thermally conductive but electrically non-conductive manner;

connecting each of said at least one thermoelectric chiller to a DC power source that is able to perform a voltage polarity switch so that each of said two junctions is capable of operating as a heating end and a cooling end, said DC power source being capable of supply varying power to each of said at least one thermoelectric chiller; and providing a control device for controlling a process time interval, said pressure isolation device, the at least one valve between the at least one pair of reactors and said at least one condenser and said at least one evaporator, the voltage polarity of the DC power source, and the power supply by the DC power source to each of said at least one thermoelectric chiller;

operating one of said two junctions as a cooling end, one of said at least one pair of reactors attached to said cooling end being cooled down while it is isolated from said at least one condenser and said at least one evaporator and subsequently connected serially to said at least one evaporator to operate as an adsorber adsorbing vapour refrigerant from said at least one evaporator for a substantial period of time; and simultaneously operating a second of said two junctions as a heating end, the other of said at least one pair of reactors attached to the heating end being heated up while it is isolated from said at least one condenser and said at least one evaporator and subsequently connected serially to said at least one condenser to operate as a desorber desorbing vapour refrigerant to said at least one condenser for a substantially identical time interval.

13. The method of cooling with an electro-adsorption chiller assembly according to claim 12, wherein said pressure isolation device is an on-off-pressure reducing valve, said method further comprising the step of operating said on-off pressure reducing valve by one of the group consisting of electromagnetic, pneumatic, hydraulic, and solid-state power.

14. The method of cooling with an electro-adsorption chiller assembly according to claim 12, wherein said pressure isolation device is a flooded U-bend.

15. The method of cooling with an electro-adsorption chiller assembly according to claim 12, further comprising the steps of:

operating said pressure isolation device by one of the group consisting of electromagnetic, pneumatic, hydraulic, and solid-state power;

serially connecting at least one pump; and spraying refrigerant onto a heat exchanger surface of said at least one evaporator with said serially connected pump.

16. The method of cooling with an electro-adsorption chiller assembly according to claim 12, further comprising the steps of operating said pressure isolation device by one of the group consisting of electromagnetic, pneumatic, hydraulic, and solid-state power;

serially connecting a pump; and distributing the refrigerant onto a heat exchanger surface of said at least one evaporator with a jet-impingement technique.

17. The method of cooling with an electro-adsorption chiller assembly according to claim 12, wherein said pressure isolation device is a flooded U-bend, said method further comprising the steps of:

serially connecting at least one pump; and spraying refrigerant onto a heat exchanger surface of said at least one evaporator with said serially connected pump.

18. The method of cooling with an electro-adsorption chiller assembly according to claim 12, wherein said pressure isolation device is a flooded U-bend, said method further comprising the steps of:

serially connecting at least one pump; and distributing the refrigerant onto a heat exchanger surface of said at least one evaporator with a jet-impingement technique.

19. The method of cooling with an electro-adsorption chiller assembly according to claim 12, wherein said at least one valve is a spool valve, said method further comprising the step of operating said spool valve by one of the group consisting of electromagnetic or pieozoelectric, pneumatic, hydraulic, and solid-state power.

* * * * *